US006237270B1

(12) United States Patent
Kovar

(10) Patent No.: US 6,237,270 B1
(45) Date of Patent: May 29, 2001

(54) METHOD OF ASSEMBLING A PICTURE FRAME

(76) Inventor: Adam B. Kovar, 23447 Schoolcraft St., West Hills, CA (US) 91307

( * ) Notice: Subject to any disclaimer, the term of this patent is extended or adjusted under 35 U.S.C. 154(b) by 0 days.

(21) Appl. No.: 09/498,524

(22) Filed: Feb. 4, 2000

Related U.S. Application Data

(63) Continuation of application No. 09/058,714, filed on Apr. 10, 1998, now abandoned.
(60) Provisional application No. 60/043,454, filed on Apr. 10, 1997.

(51) Int. Cl.[7] ..... A47G 1/06
(52) U.S. Cl. ..... 40/725; 40/766; 40/780
(58) Field of Search ..... 40/725, 739, 741, 40/765, 766, 768, 777, 780; 273/157 A, 157 R

(56) References Cited

U.S. PATENT DOCUMENTS 1,305,121 * 5/1919 Klimowicz ..... 40/739 X
1,319,513 * 10/1919 Colegrove ..... 40/618
1,421,301 * 6/1922 Petrow ..... 40/741
1,628,640 * 5/1927 Baldwin ..... 40/798
2,506,189 * 5/1950 Attridge ..... 40/739 X
2,824,398 * 2/1958 Storm ..... 40/746 X
5,335,434 * 8/1994 Shultz et al. ..... 40/746 X
5,515,630 * 5/1996 Maher ..... 40/739
5,624,118 * 4/1997 Gottesman ..... 40/739 X

* cited by examiner

*Primary Examiner*—Brian K. Green
(74) *Attorney, Agent, or Firm*—Kelly Bauersfeld Lowry & Kelley, LLP

(57) ABSTRACT

A puzzle frame kit includes a planar display having an outer periphery, and a plurality of interconnecting jigsaw puzzle pieces which, when assembled together, form a frame for the planar display. The interconnecting puzzle pieces include a plurality of primary frame members which cooperatively define a channel for receiving all but an exposed portion of the outer periphery of the planar display, at least one closure member which is configured to cooperate with the primary frame members to enclose the planar display, and at least one locking member which is interconnectable to the closure member and one or more adjacent primary frame members. A pair of legs are attachable to the frame which extend outwardly therefrom to support and hold the frame upright relative to a generally horizontal surface. The kit further includes paint and a paintbrush for decorating a surface of the frame either before or after assembly.

4 Claims, 6 Drawing Sheets

METHOD OF ASSEMBLING A PICTURE FRAME

RELATED APPLICATIONS

This application is a continuation of Ser. No. 09/058,714, filed Apr. 10, 1998, now abandoned, which claimed priority from provisional application No. 60/043,454 filed Apr. 10, 1997.

BACKGROUND OF THE INVENTION

This invention relates generally to handicraft kits. More specifically, the present invention relates to a kit for making a picture frame from puzzle pieces, and a related method of assembling the picture frame.

It is customary to place portraits, photographs, paintings and the like within frames to display around ones home or business. Often the nature of the art work to be displayed determines the nature of the frame selected. In this regard, formal portraits and expensive pieces of art may justify professionally crafted frames that tend to be quite expensive. In the home one will often find pre-manufactured frames into which a photograph or the like may be placed, which are much less expensive than the professionally crafted frames associated with portraits and expensive art work.

There is often a desire to add a personal touch to items around the home or the office, and in this vein some have taken to decorating manufactured frames with their own art work. The appeal of a personalized picture frame is particularly evident when meaningfully personal picture is to be displayed within the home.

The handicraft industry within the United States is large and continues to grow in response to a demand by consumers for products that will allow them to personalize products. With regard to picture frames, however, handicrafters have been limited to pre-manufactured frames of various shapes which may be painted or otherwise decorated to meet individual tastes and preferences. Prior to the present invention, there has not been a picture frame kit that combined the elements of a puzzle assembly with a picture frame, which can be decorated by the end user to meet his or her particular preferences.

Accordingly, there has been a need for a novel handicraft kit in the nature of a puzzle frame kit wherein puzzle pieces are provided that may be assembled together to form a picture frame. Additionally, there is a need for such a product that may be decorated by the consumer to meet individual needs and preferences. Moreover, a novel method of assembling such a puzzle picture frame kit is needed which advantageously performs the utilitarian function of serving as a picture frame when assembled, yet is easy to assemble by the consumer. The present invention fulfills these needs and provides other related advantages.

SUMMARY OF THE INVENTION

The present invention resides in a puzzle frame kit which comprises a planar display for a portrait, photograph, painting or the like, and a plurality of interconnecting jigsaw puzzle pieces which, when assembled together, form a frame for the planar display. The invention further resides in a method of assembling a picture frame involving the assembly of a plurality of interconnecting puzzle pieces in such a manner that they are capable of securely holding the outer periphery of a planar display positioned therein.

In a preferred from of the invention, the planar display includes a backing plate, a transparent lens and an image bearing sheet between the backing plate and the transparent lens. The planar display defines an outer periphery that is to be supported within the plurality of interconnecting puzzle pieces.

The plurality of interconnecting puzzle pieces which, when assembled together form a frame for the planar display, include a plurality of primary frame members which cooperatively define a channel for receiving therein all but an exposed portion of the outer periphery of the planar display. Each primary frame member includes a groove which forms a portion of the display-receiving channel when the primary frame members are assembled together. At least one closure member is configured to cooperate with the primary frame members to enclose the planar display. The at least one closure member has a groove therein into which the exposed portion of the outer periphery is inserted. The interconnecting puzzle pieces further include at least one locking member which is interconnectable to the at least one closure member and an adjacent primary frame member.

Means are provided for supporting the assembled frame and holding it upright relative to a generally horizontal surface. The supporting and holding means comprises a pair of legs attachable to the frame and extending outwardly therefrom. At least one of the interconnecting puzzle pieces includes at least one aperture for receiving at least one of the pair of legs therein.

Further, means for decorating a surface of the frame are provided. The decorating means includes paint and a paintbrush.

In a method of assembling the picture frame, the plurality of interconnecting primary frame member jigsaw puzzle pieces are assembled together to form a portion of the frame which is capable of supporting therein an outer periphery of the planar display. The assembled interconnecting primary frame member jigsaw puzzle pieces are fitted to one another in a perpendicular motion relative to the primary plane of the picture frame. The assembled interconnecting primary frame member puzzle pieces cooperatively define a channel. The planar display is then inserted into the channel such that all but an exposed portion of the outer periphery is captured by the interconnecting primary frame jigsaw puzzle pieces. The at least one closure member jigsaw puzzle piece is then placed over the exposed portion of the outer periphery of the planar display, and then at least one interconnecting locking member jigsaw puzzle piece is perpendicularly dropped, relative to the primary plane, into the primary plane to interconnect and lock the locking member jigsaw puzzle piece to both at least one closure member jigsaw puzzle piece with an adjacent primary frame jigsaw puzzle piece.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
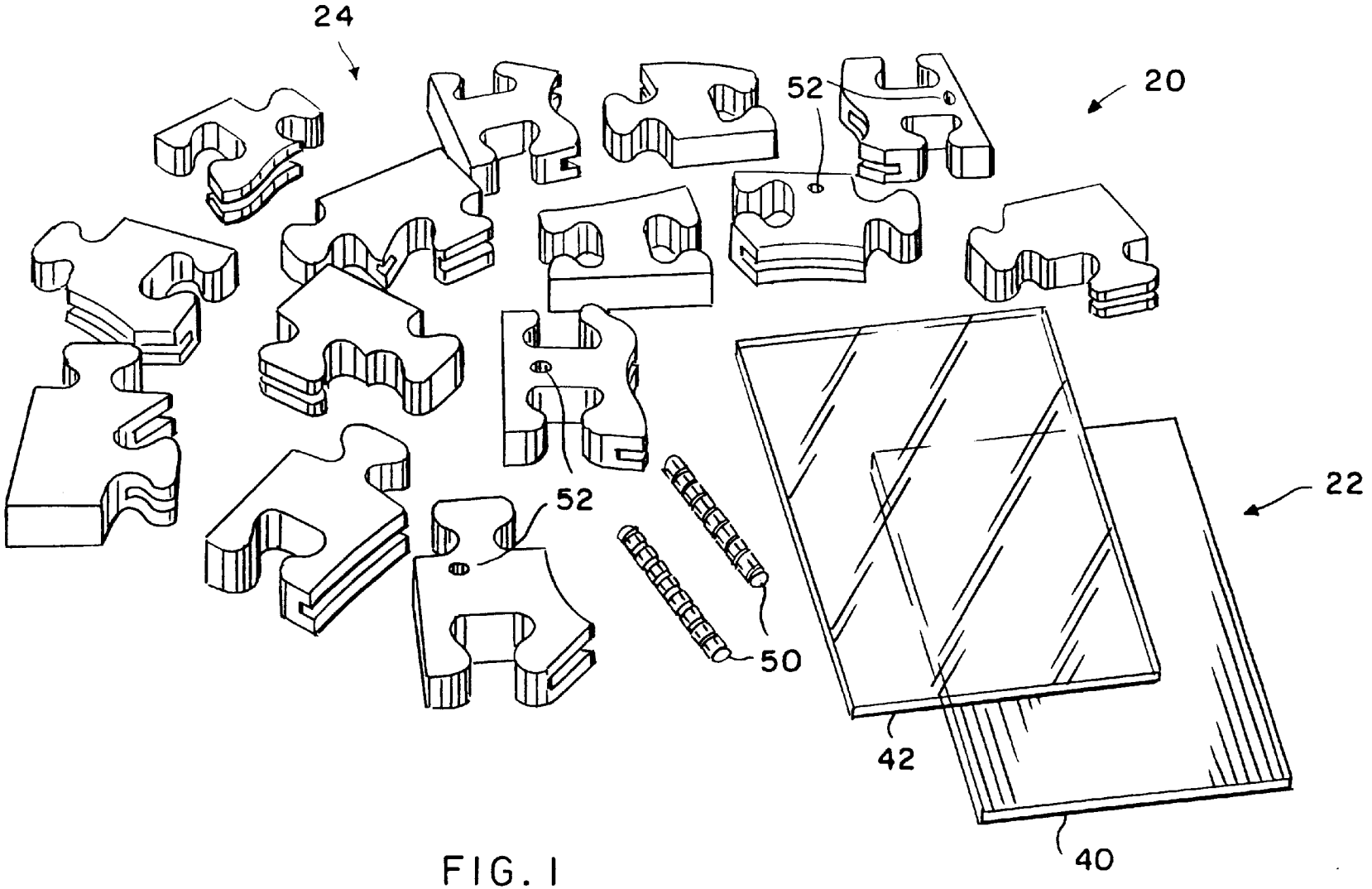
FIG. 1 is a perspective view of many of the components of a puzzle frame kit embodying the present invention.
Figure 3:
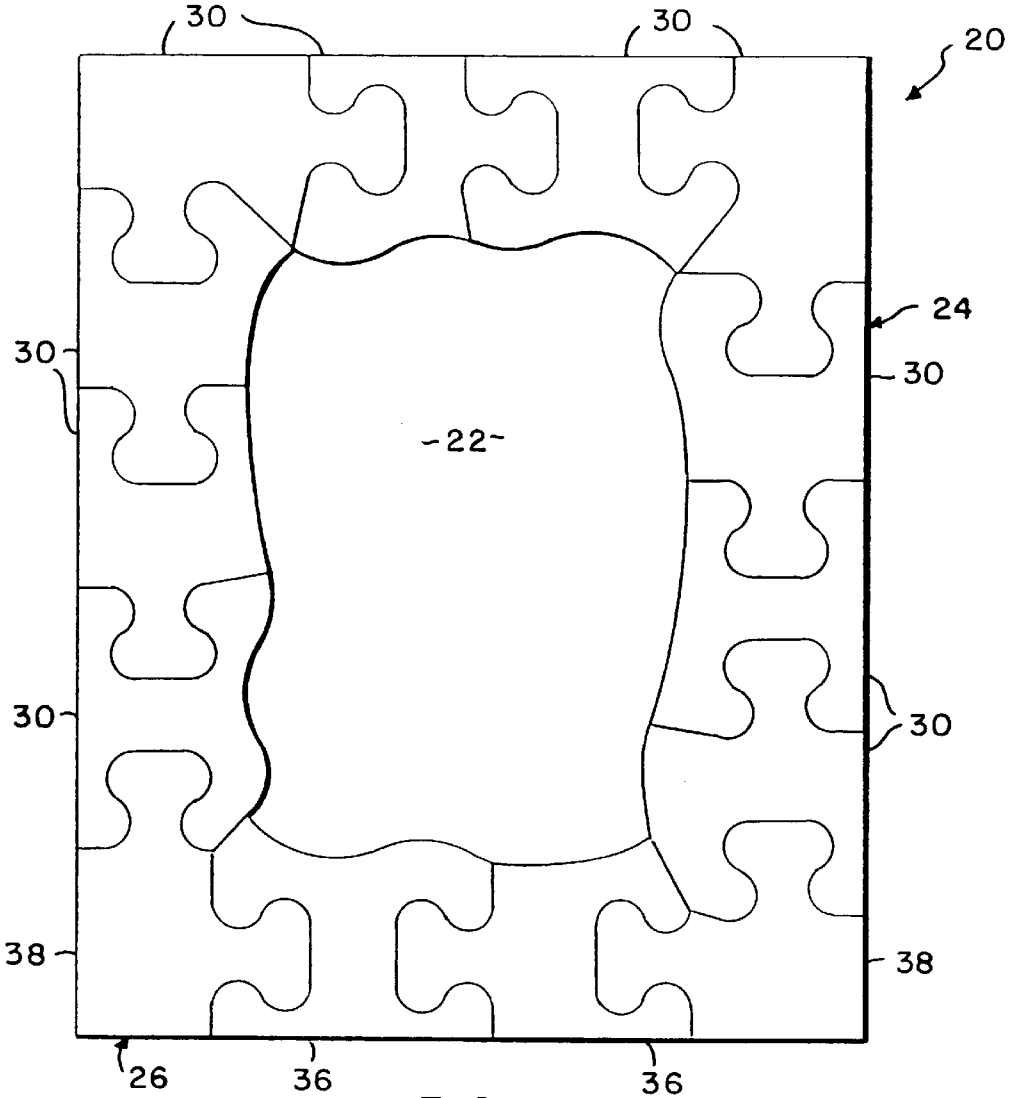
FIG. 3 is a front elevational view of the puzzle frame kit of FIG. 1, illustrating a plurality of interconnecting puzzle pieces assembled together to form a frame for a planar display.
Figure 2:
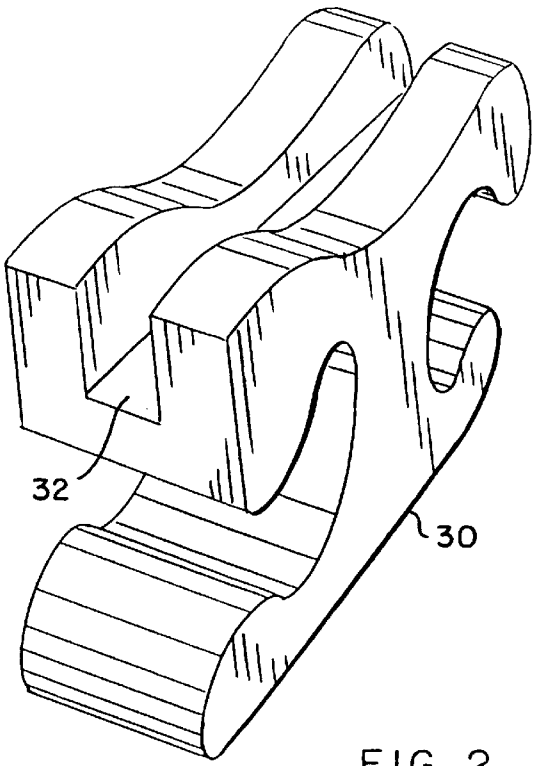
FIG. 2 is an enlarged perspective view of an exemplary interconnecting puzzle piece.

As shown in the drawings for purposes of illustration, the present invention resides in a novel puzzle frame kit, generally designated by the reference number 20. In general, the puzzle frame kit 20 comprises a planar display 22 for a portrait, photograph, painting or the like, and a plurality of interconnecting jigsaw puzzle pieces 24 which, when assembled together, form a frame 26 for the planar display 22. The invention further resides in a method for assembling the picture frame 26 involving the assembly of the puzzle pieces 24 in such a manner that they are capable of securely holding the outer periphery 28 of the planar display 22 positioned therein.

With reference to FIGS. 1–8, the interconnecting puzzle pieces 24 comprise a plurality of primary frame members 30 which, when assembled together, form three sides of the picture frame 26. Due to the irregular shape of the jigsaw puzzle pieces 24, they must necessarily be interconnected to one another in a perpendicular motion relative to a primary plane of the picture frame 26. Each of the primary frame members 30 defines a segment of the outer periphery of the frame 26 and includes an inner groove 32 that is configured to capture a portion of the outer periphery 28 of the planar display 22. When the primary frame members 30 are assembled together (FIG. 4), the individual grooves 32 of said frame members 30 are aligned with one another to form a channel 34 for receiving therein all but an exposed portion of the outer periphery 28 of the planar display 22.

Figure 4:
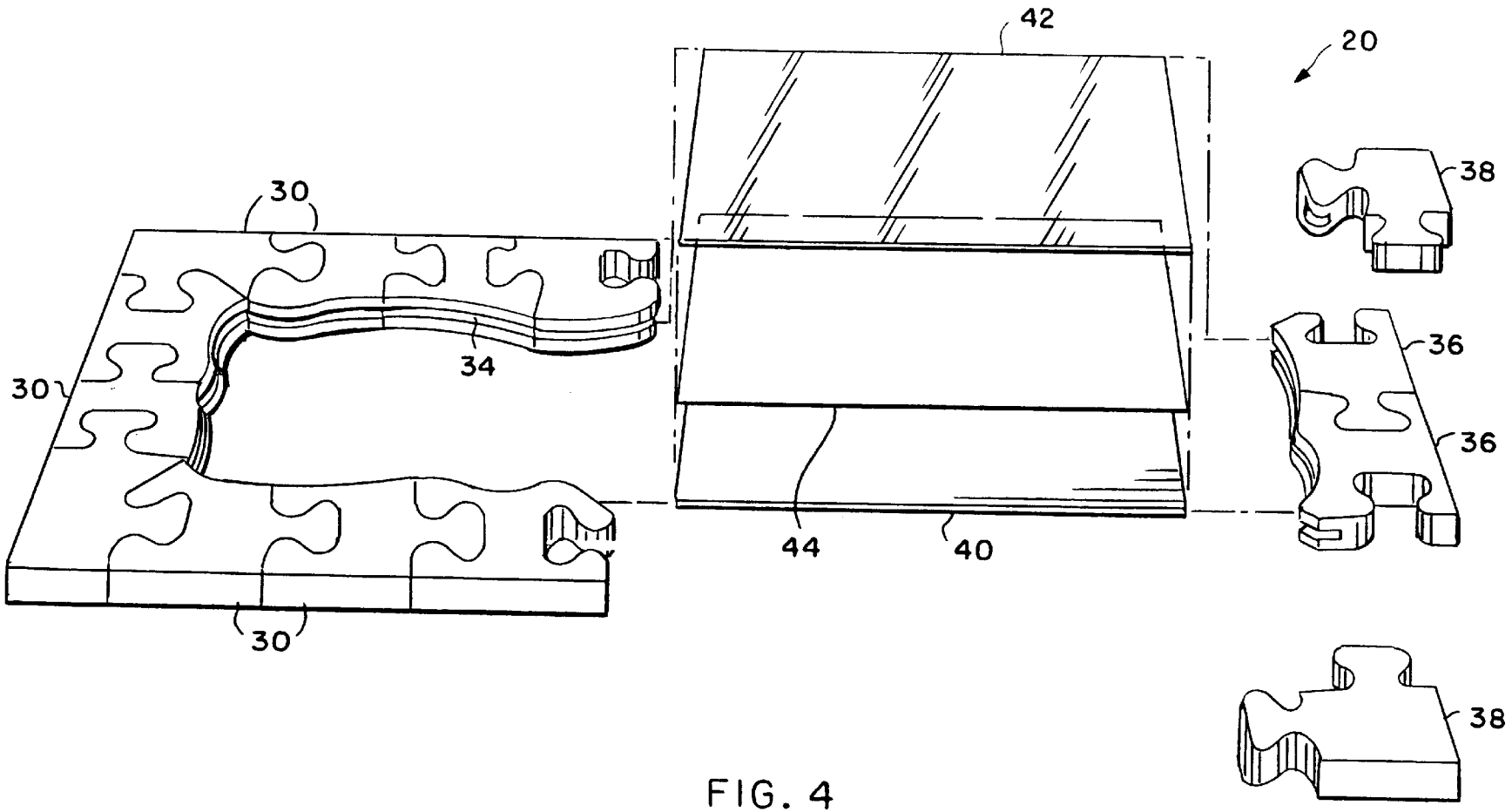
FIG. 4 is an exploded perspective view of the puzzle frame kit components forming the picture frame shown in FIG. 3.
Figure 5:
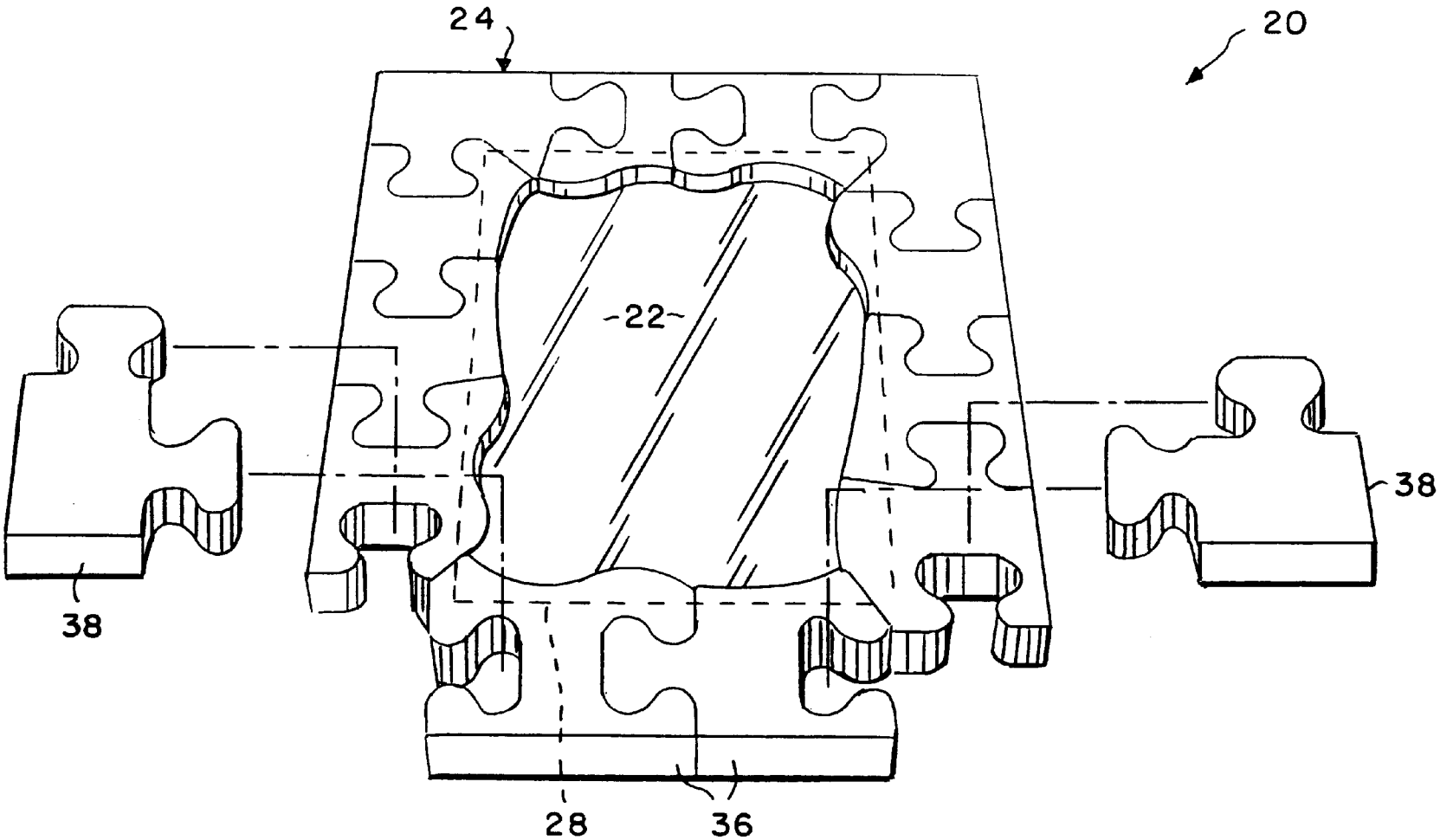
FIG. 5 is another perspective view of the picture frame kit of FIGS. 3 and 4, illustrating the step of interconnecting a pair of closure members to adjacent primary frame members utilizing a pair of locking members.

Following assembly of the primary frame members 30, the planar display 22 may be inserted into the channel 34, and then one or more closure members 36 may be placed over the exposed portion of the outer periphery 28 to completely enclose the outer periphery. The closure members 36 also each include a groove 32 into which the exposed portion of the outer periphery 28 of the planar display 22 is placed, and the closure members 36 are configured to abut up against adjacent primary frame members 30 but they do not interconnect therewith. Rather, as illustrated in FIGS. 4 and 5, a pair of locking members 38 are provided for interconnecting the closure members 36 with adjacent primary frame members 30. As illustrated in FIG. 5, the locking member 36 must also be perpendicularly dropped into the primary plane of the picture frame 26 in order to interconnect and lock the closure member 36 and the adjoining primary frame member 30 jigsaw puzzle pieces.

As illustrated in FIG. 4, the planar display 22 includes a backing plate 40, a transparent lens 42 and an image bearing sheet 44 that is disposed between the backing plate and the transparent lens. The image bearing sheet 44 may be a portrait, photograph, painting or the like, and is typically inserted between the backing plate 40 and the transparent lens 42 prior to inserting the assembled planar display 22 into the channel 34 provided by the interconnected primary frame members 30.

Figure 6:
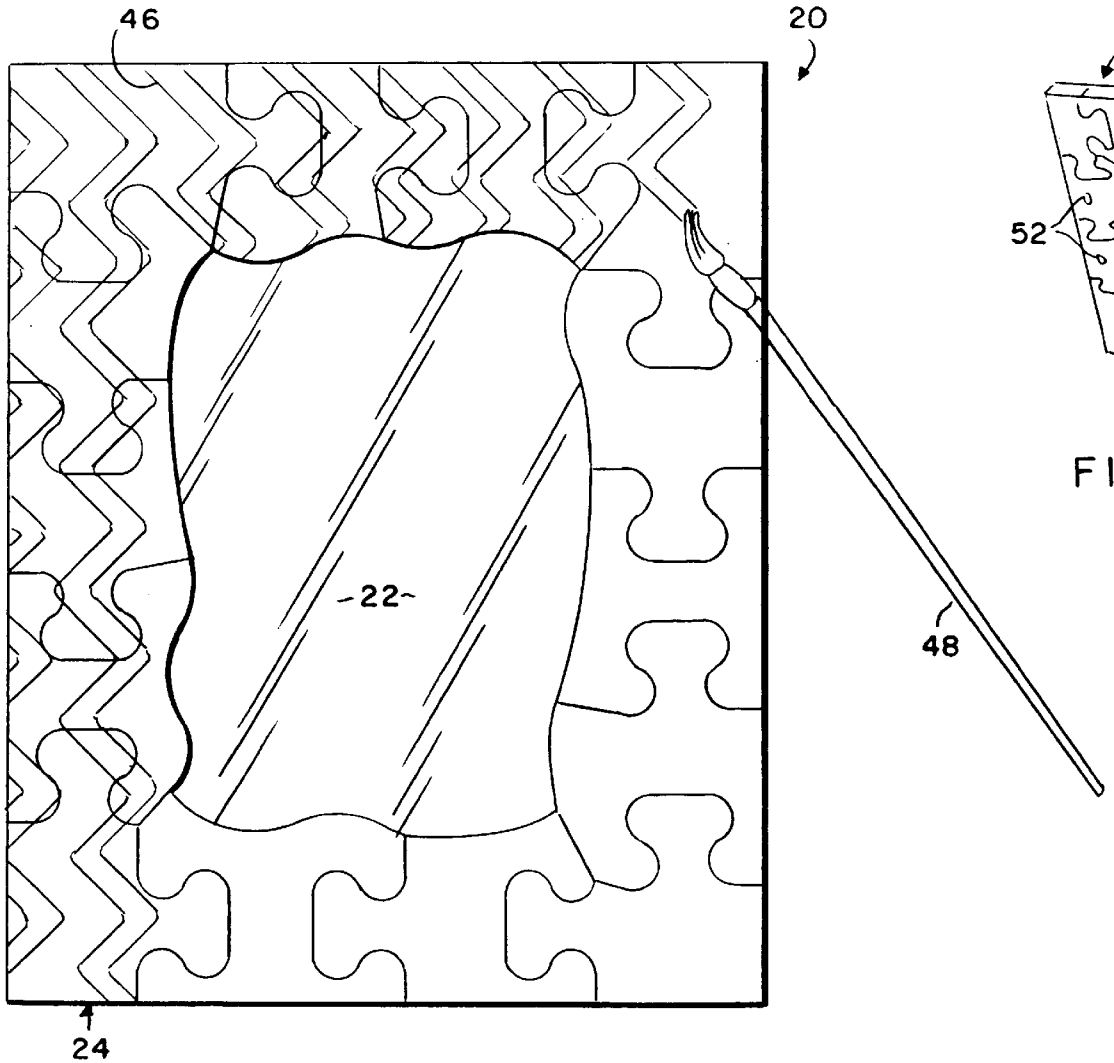
FIG. 6 is a front elevational view of the picture frame kit similar to FIG. 3, illustrating utilization of paint and a paint brush to decorate a surface of the interconnecting puzzle pieces.

Once the frame 26 has been assembled as described above, the outer surface thereof may be decorated utilizing paint 46 and a paint brush 48 (FIG. 6).

Figure 7:
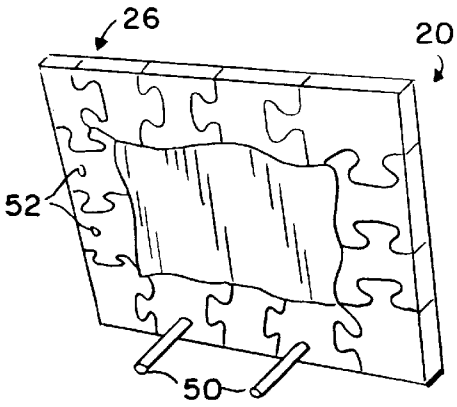
FIG. 7 is a rear and side perspective view of the picture frame kit of FIGS. 1–6, illustrating one method for supporting the assembled frame and holding it upright relative to a generally horizontal surface.
Figure 8:
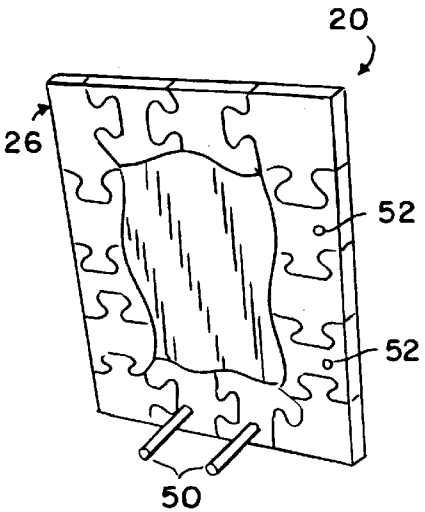
FIG. 8 is a rear and side perspective view similar to FIG. 7, illustrating an alternative method for supporting the assembled frame and holding it upright relative to a generally horizontal surface.

Moreover, means are provided for supporting the assembled frame 26 and holding it upright relative to a generally horizontal surface. The supporting and holding means comprises a pair of wooden legs 50 that are attachable to the frame 26 so as to extend outwardly therefrom. In this regard, several of the interconnecting puzzle pieces 24 are provided apertures 52 in a rear surface thereof, into which an end of a respective leg 50 may be inserted. FIG. 7 illustrates the legs 50 positioned within two apertures 52 so as to hold the frame 26 in a landscape-type orientation. FIG. 8, on the other hand, illustrates the legs 50 inserted into apertures 52 so as to hold the frame 26 in a portrait-type orientation.

Figure 9:
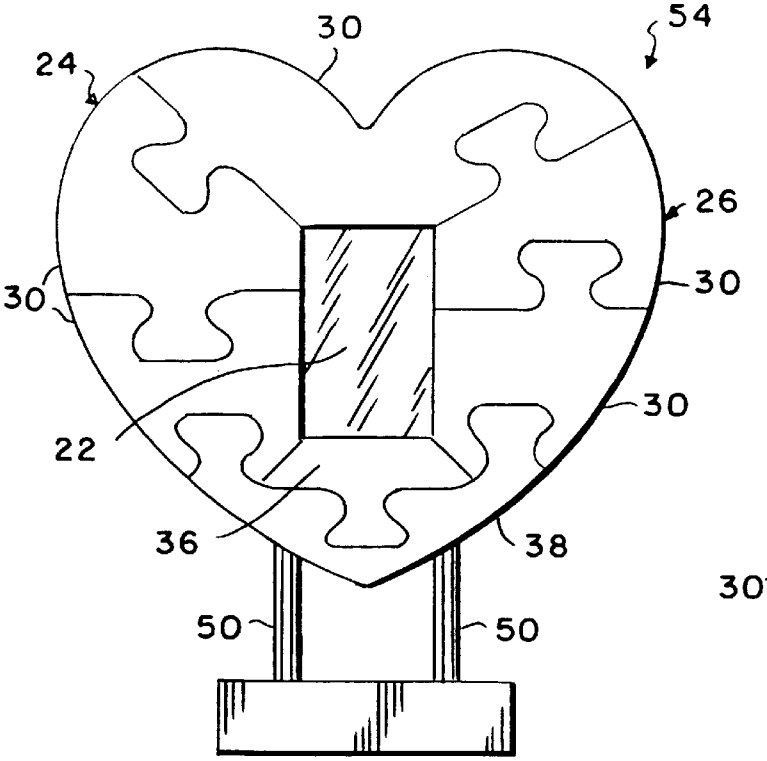
FIG. 9 is a front elevational view of an alternative embodiment of the puzzle frame kit of the present invention.

Of course, the puzzle frame kit 20 of the present invention is not limited to the rectangular configuration of the frame 26 illustrated in FIGS. 1–8. In this regard, FIG. 9 illustrates an alternative puzzle frame kit 54 wherein the interconnecting puzzle pieces 24 are configured to create, when assembled together, a heart-shaped picture frame. In this case, only one closure member 36 and one locking member 38 are utilized to enclose the outer periphery 28 of the planar display 22 and to interconnect the closure member 36 to the adjacent primary frame members 30.

Figure 10:
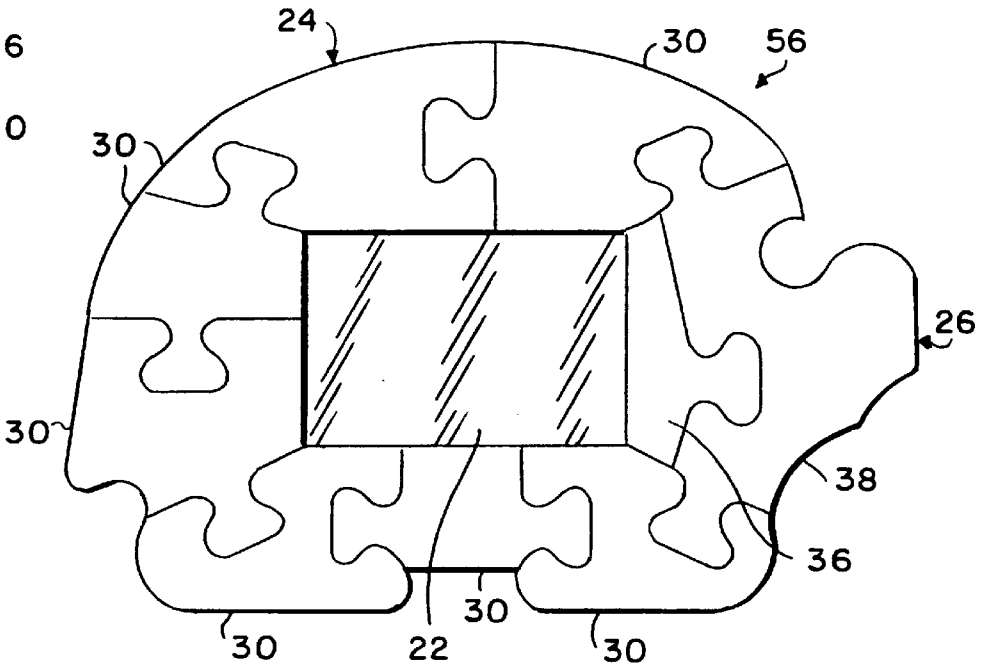
FIG. 10 is a front elevational view of another alternative embodiment of the puzzle frame kit of the present invention.

FIG. 10 illustrates yet another puzzle frame kit 56, wherein the interconnecting puzzle pieces 24, when assembled together, create the outline of a turtle.

From the foregoing it will be appreciated that the puzzle frame kits 20, 54 and 56 of the present invention provide novel handicraft kits in the nature of a puzzle frame kit wherein puzzle pieces are provided that may be assembled together to form a picture frame. The resultant product may be decorated by the consumer to meet individual needs and preferences.

Although several embodiments of the present invention have been described in detail for purposes of illustration, various modifications of each may be made without departing from the spirit and scope of the invention. Accordingly, the invention is not to be limited, except as by the appended claims.

I claim:

1. A method of assembling a picture frame surrounding a planar display, comprising the steps of:

assembling a plurality of interconnecting primary frame member jigsaw puzzle pieces by fitting adjoining primary frame member jigsaw puzzle pieces in a perpendicular motion relative to a primary plane of the picture frame to form a portion of the picture frame capable of supporting therein an outer periphery of the planar display, wherein the plurality of interconnecting primary frame member jigsaw puzzle pieces cooperatively define a channel;

inserting the planar display into the channel such that the outer periphery thereof is captured by the interconnecting primary frame member jigsaw puzzle pieces;

placing at least one closure member jigsaw puzzle piece over the exposed portion of the outer periphery of the planar display; and interconnecting the at least one closure member jigsaw puzzle piece with an adjacent primary frame member jigsaw puzzle piece utilizing at least one interconnecting locking member puzzle piece, said interconnecting step comprising the step of perpendicularly dropping the locking member jigsaw puzzle piece, relative to the primary plane, into the primary plane to lock the locking member jigsaw puzzle piece to both the at least one closure member jigsaw puzzle piece and the adjacent primary frame member jigsaw puzzle piece.

2. The method of claim 1, including the step of supporting the assembled frame and holding it upright relative to a generally horizontal surface.

3. The method of claim 2, wherein the supporting and holding step includes the step of inserting a pair of legs into the frame such that the legs extend outwardly therefrom.

4. The method of claim 1, including the step of decorating a surface of the frame.

* * * * *